US008029340B2

(12) United States Patent
Henning et al.

(10) Patent No.: US 8,029,340 B2
(45) Date of Patent: Oct. 4, 2011

(54) QUICK MOUNT ADAPTER AND BACKING PLATE SURFACE CARE SYSTEM AND APPARATUS

(75) Inventors: Lee A. Henning, Brookfield, WI (US); Gregg R. Sorenson, West Allis, WI (US)

(73) Assignee: D.C. Henning, Inc., Milwaukee, WI (US)

( * ) Notice: Subject to any disclaimer, the term of this patent is extended or adjusted under 35 U.S.C. 154(b) by 743 days.

(21) Appl. No.: 12/100,665

(22) Filed: Apr. 10, 2008

(65) Prior Publication Data

US 2008/0254725 A1 Oct. 16, 2008

Related U.S. Application Data

(60) Provisional application No. 60/910,888, filed on Apr. 10, 2007.

(51) Int. Cl.
*B24B 23/00* (2006.01)

(52) U.S. Cl. ..... 451/359; 451/508

(58) Field of Classification Search ..... 451/359, 451/357, 490, 508, 509, 344
See application file for complete search history.

(56) References Cited

U.S. PATENT DOCUMENTS

| | | | | |
|---|---|---|---|---|
| 3,347,566 | A | 10/1964 | Nelson | |
| 3,252,721 | A * | 5/1966 | Weasler | 403/318 |
| 4,663,796 | A * | 5/1987 | Helling et al. | 15/144.2 |
| 4,986,704 | A | 1/1991 | Narushima | |
| 5,185,964 | A | 2/1993 | Englund | |
| 5,396,737 | A | 3/1995 | Englund | |
| 5,464,229 | A * | 11/1995 | Salpaka | 279/30 |
| D367,743 | S | 3/1996 | Krause | |
| 5,651,726 | A | 7/1997 | Skogsberg | |
| 5,806,132 | A | 9/1998 | Kelley | |
| 5,855,451 | A | 1/1999 | Milton | |
| 6,095,910 | A | 8/2000 | Luedeke | |
| 6,105,197 | A | 8/2000 | Umbrell | |
| 6,457,916 | B2 | 10/2002 | Wienhold | |
| 6,523,214 | B1 | 2/2003 | Kaiser | |
| 6,561,523 | B1 * | 5/2003 | Wienhold | 279/30 |
| 6,640,377 | B2 | 11/2003 | Krause | |
| 6,651,286 | B2 | 11/2003 | Pierce | |
| 6,719,619 | B2 | 4/2004 | Kuo | |
| 6,895,631 | B1 | 5/2005 | Krause | |
| 6,929,539 | B2 | 8/2005 | Schutz | |
| 6,939,213 | B2 * | 9/2005 | Lovchik et al. | 451/360 |
| 7,387,479 | B1 * | 6/2008 | Lee | 409/232 |
| 2007/0204420 | A1 | 9/2007 | Hornby | |

FOREIGN PATENT DOCUMENTS

| | | |
|---|---|---|
| WO | WO/02/100599 | 12/2002 |

* cited by examiner

*Primary Examiner* — Robert Rose
(74) *Attorney, Agent, or Firm* — Joseph S. Heino; Patrick M. Bergin

(57) ABSTRACT

A quick mount adapter and backing plate is provided for use with a surface care tool of conventional manufacture, the tool including a male or female drive spindle with or without an adapter interface. A surface care media is attached directly to the backing plate. The quick mount adapter is configured with an inner sleeve member and an outer sleeve member, the sleeve members being axially movable and spring-biased in relation to one another. A plurality of keeper balls is disposed between the sleeve members to selectively engage and disengage a circumferential groove that is disposed within a hub of the backing plate. The backing plate is configured to be attachable to the quick mount adapter, the quick mount adapter being attachable to the threaded portion of a drive spindle, and to the threaded portion of the drive spindle itself.

22 Claims, 7 Drawing Sheets

QUICK MOUNT ADAPTER AND BACKING PLATE SURFACE CARE SYSTEM AND APPARATUS

This application claims the benefit and priority of U.S. Provisional Patent Application No. 60/910,888 filed Apr. 10, 2007.

FIELD OF THE INVENTION

This invention relates generally to surface preparation and finishing products, including surface care media, that are used with rotary or oscillating surface preparation and finishing tools. More particularly, this invention relates to a mounting system and apparatus for quickly connecting the backing plate and its associated surface care media to a rotary or oscillating surface care tool and for quickly disconnecting the plate and media from the surface care tool when such is desired or required. It also particularly relates to a unique backing plate configuration that allows the backing plate to be utilized with the mounting system of the present invention and, alternatively, with the threaded spindle of a conventional surface care tool.

BACKGROUND OF THE INVENTION

The present inventors are aware of prior art that provides a wide variety of rotary or oscillating surface preparation and finishing tools, which can be collectively referred to as "surface care tools," as well as related attachments, including "surface care media," for such tools. Indeed, rotary or oscillating surface preparation and finishing tools are well known in the art. Such surface care tools include, among others, rotary, dual action, oscillating, random orbital or other motion-controlled tools or hand fixtures. A wide variety of attachments for use with such tools also exists and such attachments are similarly known in the art. The available attachments may be attached to and detached from a drive spindle by use of a variety of attachment means. The most typical attachment means is to provide a mechanism for securing the backing plate of a surface preparation or finishing media, such as a buffing pad, directly to the threaded spindle of the rotary or oscillating surface preparation or finishing tool. In the environment where surface preparation or finishing tools of this nature are typically used, however, it is desirable to provide means whereby the backing plate of the surface preparation or finishing media is also quickly and easily removed from the surface care tool. However, mounting of the backing plate in the aforementioned fashion typically is not quick or easy. That is, doing so most frequently requires screwing the attachment on and off by hand, with significant pressure being required to remove the attachment the longer the attachment has been used.

Accordingly, alternative designs of a "quick release" configuration have also included a backing plate that uses Velcro®-type hook and loop surface technology whereby the surface care media (via loops, for example) is attached to the backing plate (via hooks, for example) and the backing plate is, in turn, attached to the spindle of the rotary or oscillating surface preparation or finishing tool. In this type of application, the media itself is provided with a separate backing surface in order to provide sufficient structural support for the loops that are used to connect the media to the backing plate. In addition to increasing the number of different materials that are required to be used with this type of configuration, as well as increasing its complexity, this type of attachment configuration also frequently suffers from precise centering of the surface preparation or finishing media relative to the backing plate. This, in turn, directly results in "wobbling" of the surface preparation or finishing media that is attached to the backing plate during use. That is, there is a problem with the "concentricity" of the media relative to the backing plate. The obvious intended purpose of this type of configuration is to allow the user to minimize handling of the surface preparation or finishing media. However, misalignment and the presence of wobble in the media will often require to user to detach and then re-attach the surface preparation or finishing media several times before this "wobble" is minimized or eliminated. Even a minimal amount of wobble can compromise the quality and consistency of the surface finishing result. Increased wobble can also increase operator fatigue and create the potential for long-term user injury from repeated wobbling vibrations. Furthermore, it is also known to these inventors that the more the media and backing plate is rotated, the more difficult it is to detach the media from the backing plate, as more force or pressure is required to effect this detachment.

In the view of these inventors, there is a clear need to provide an improved system and apparatus that comprises a backing plate with attached surface preparation or finishing media which allows the user to quickly and easily remove the backing plate and its attached media from the surface care tool. By permanently attaching the surface care media to the backing plate, the inadequacies of the hook and loop attachment system are eliminated and this construction would improve the durability of the media. This is true especially around chemicals that are used with the media and in view of washings that are intended to extend the useful life of the surface care media.

There is a need to provide such a system and apparatus while also orientating the backing plate and its associated surface care media in such a way that the spindle of the surface care tool is precisely centered relative to the backing plate and the surface care media that is attached to it. In this fashion, the consistency of the surface preparation and finishing result is enhanced by means of balanced concentricity of the media, which would eliminate wobble, and improve the quality and consistency of the surface finish. What is also needed is such a system and apparatus that utilizes a minimal number of elements and a minimal number of steps to use, thereby making the system and apparatus one that is easy and simple to use, as well as one that minimizes handling of the surface care media and thereby reduces the time to change worn pads or to transition to a different type of pad that would be needed for the next phase of a surface care project. This type of a system and apparatus would also minimize cross-contamination of pads with surface particulate from other previously-used pads or media.

What is also needed is such a system and apparatus that results in securely attaching the backing plate and its associated surface care media to the surface care tool such that the backing plate will not inadvertently detach from the surface care tool under normal use conditions. What is also needed is such a system and apparatus that is versatile such that it also allows the user to alternatively utilize the backing plate with the threaded spindle of a conventional surface care tool when such is desired or required by the user.

SUMMARY OF THE INVENTION

It is, therefore, a principal object of this invention to provide a new and useful system and apparatus that allows the user to quickly and easily remove the backing plate and its attached surface care media from a surface care tool. It is another object of this invention to provide such a system and apparatus that allows for presentation of the backing plate relative to the surface care tool in such a way that the tool spindle is precisely centered relative to the backing plate and its associated surface care media. It is another object of this invention to provide such a system that utilizes a minimal number of elements and requires a minimal number of steps to use, thereby making the system easy and simple to use and minimizing the need to handle the media and the surface preparation or finishing particulate that may be accumulated on the media. It is yet another object of the present invention to provide such a system that securely attaches the backing plate and its associated surface preparation or finishing media to the rotary or oscillating tool such that the backing plate will not inadvertently detach from the tool under normal use conditions. It is still another object of the present invention to provide such a system that allows the user to alternatively utilize the backing plate of the system with the threaded spindle of a conventional rotary or oscillating tool when such is desired or required.

The system of the present invention has obtained these objects. It provides for a quick mount adapter and backing plate that can be used with a surface care tool of conventional manufacture, the tool including a drive spindle. The surface preparation or finishing media, or simply "the surface care media," is attached directly to the backing plate in the preferred embodiment of the present invention. The quick mount adapter is configured with an inner sleeve member and an outer sleeve member, the sleeve members being axially movable and spring-biased in relation to one another. A plurality of keeper balls is disposed between the sleeve members to selectively engage and disengage a circumferential groove that is disposed within a hub of the backing plate. Alternatively, a plurality of detents would be defined within the hub, each detent being configured to capture a ball within it. The backing plate is thereby attachable to the quick mount adapter, the quick mount adapter being attachable to the threaded portion of a drive spindle, and to the threaded portion of the drive spindle itself.

The foregoing and other features of the system and apparatus of the present invention will be apparent from the detailed description that follows.

DETAILED DESCRIPTION OF THE PREFERRED EMBODIMENT

Figure 1:
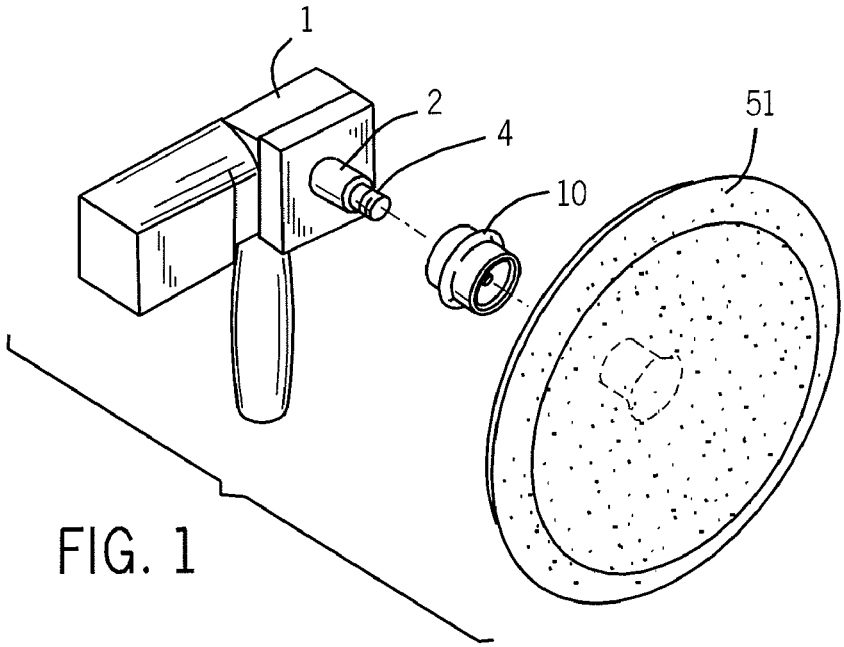
FIG. 1 is an exploded top, front and left side perspective view of an exemplary rotary surface finishing tool having a drive spindle that would be used with the quick mount adapter, backing plate and surface care media of the present invention.

Referring now to the drawings in detail, wherein like numerals represent like structure and elements throughout, FIG. 1 illustrates a preferred embodiment of the quick mount adapter and backing plate surface care system and apparatus that is constructed in accordance with the present invention. As shown, a representative surface care tool, generally identified 1, is also illustrated. The tool 1 has a drive spindle 2 with a threaded portion 4 of the type that would be used with the quick mount adapter and backing plate surface care system and apparatus of the present invention.

In this detailed description, it is to be understood that the system and apparatus of the present invention could be used with virtually any rotary, dual action, oscillating, random orbital or other motion-controlled tools or hand fixtures other than that illustrated in FIG. 1. All such tools will be collectively referred to in this detailed description and in the claims as "surface care tools," or singularly as a "surface care tool." The particular surface care tool 1 shown in FIG. 1 is presented for purposes of illustrating enablement of the invention only and is in no way limiting of the present invention.

Figure 2:
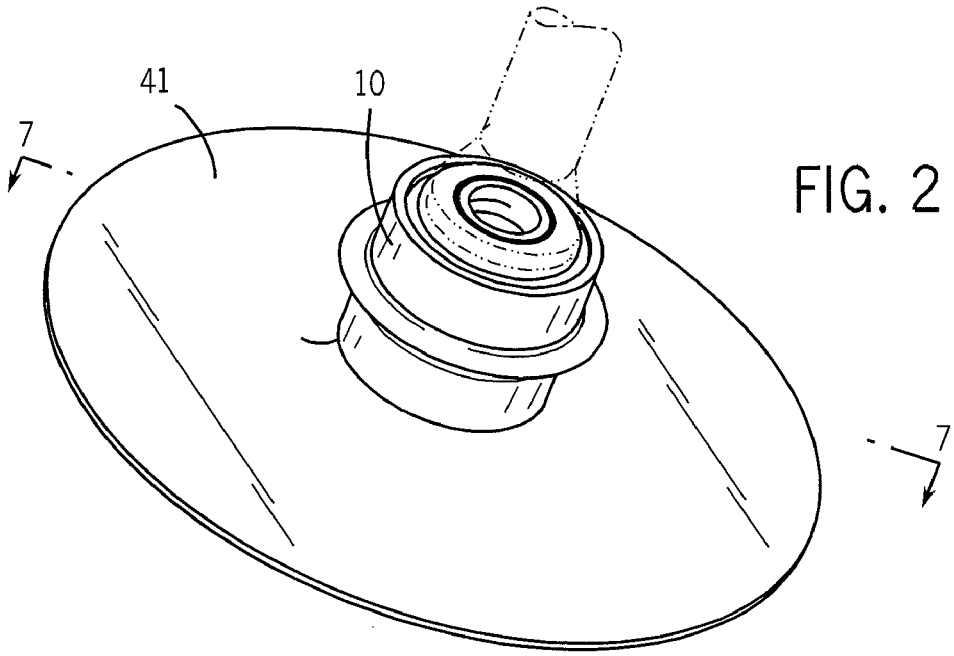
FIG. 2 is an enlarged top, rear and side perspective view of the quick mount adapter and the backing plate of the surface finishing, or "buffing," pad illustrated in FIG. 1.
Figure 3:
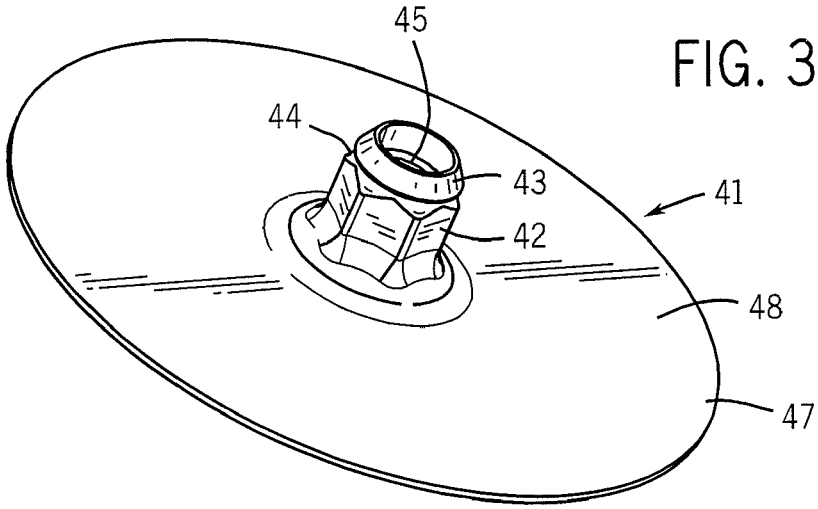
FIG. 3 is a view of the backing plate that is similar to FIG. 2 but showing the quick mount adapter removed.

The quick mount adapter, generally identified 10, would be threadably attachable to the threaded portion 4 of the drive spindle 2 of the surface care tool. As illustrated in this FIG. 1, the backing plate 41 (shown also in FIG. 2 by itself and in FIG. 3) would be part of a buffing pad assembly with surface care media, generally identified 51. It is to be understood that the buffing pad assembly 51 shown is solely for purposes of illustrating enablement of the present invention and is not a limitation of the present invention. A wide variety of such assemblies could be shown, each coming within the scope of the present invention. The buffing pad assembly with media 51 would, in turn, be attachable to the quick mount adapter 10 as will be apparent later in this detailed description. FIG. 2 illustrates more clearly the connection that is made between the quick mount adapter 10 and the backing plate 41.

Here again, it is to be understood that the buffing pad assembly 51 shown and discussed here can include, without limitation, any type of "surface care media" that would be used in the surface care industries. It is also to be understood that the system and apparatus of the present invention is not limited to a "buffing pad," which is referenced and discussed here for purposes of illustrating enablement of the present invention only.

Figure 10:
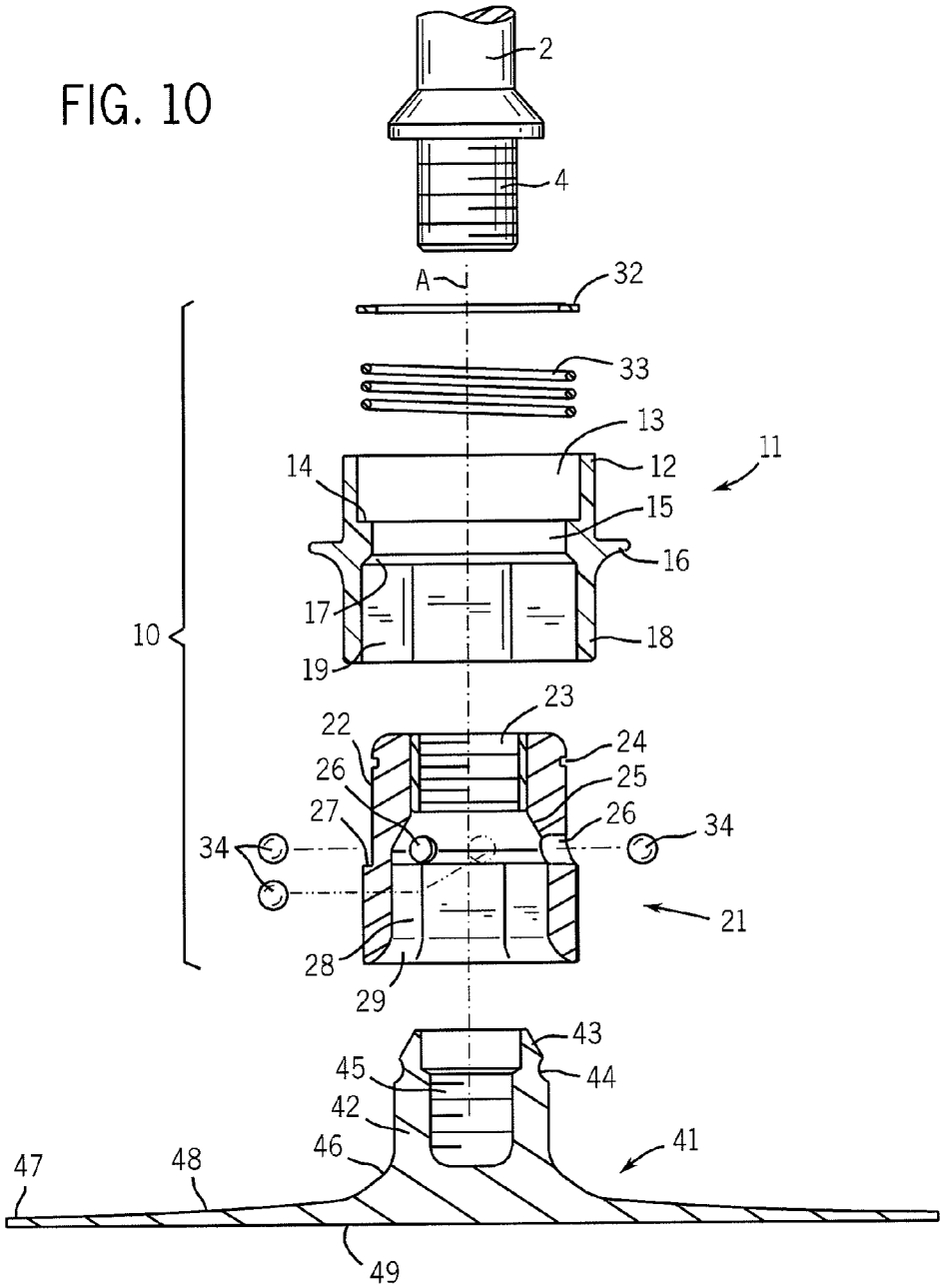
FIG. 10 is an exploded and partially cross-sectioned view of the quick mount adapter and backing plate of the present invention.

Referring now to FIG. 10, it illustrates an exploded and partially cross-sectioned view of the quick mount adapter 10 and backing plate 41 of the present invention, showing in much greater detail the features of each of those assembly components. Moving downwardly from the top of FIG. 10, there is first shown a drive spindle 2 that includes an integrally-formed threaded portion 4. In the preferred embodiment of the present invention, the quick mount adapter 10 includes a number of essential elements—a cylindrically-shaped outer sleeve 11, a partially cylindrically-shaped inner sleeve 21, a ring 32, a spring 33 and a plurality of balls 34. With the exception of the balls 34, each element is linearly disposed along the central axis line A as is shown in FIG. 10 as well.

Figure 4:
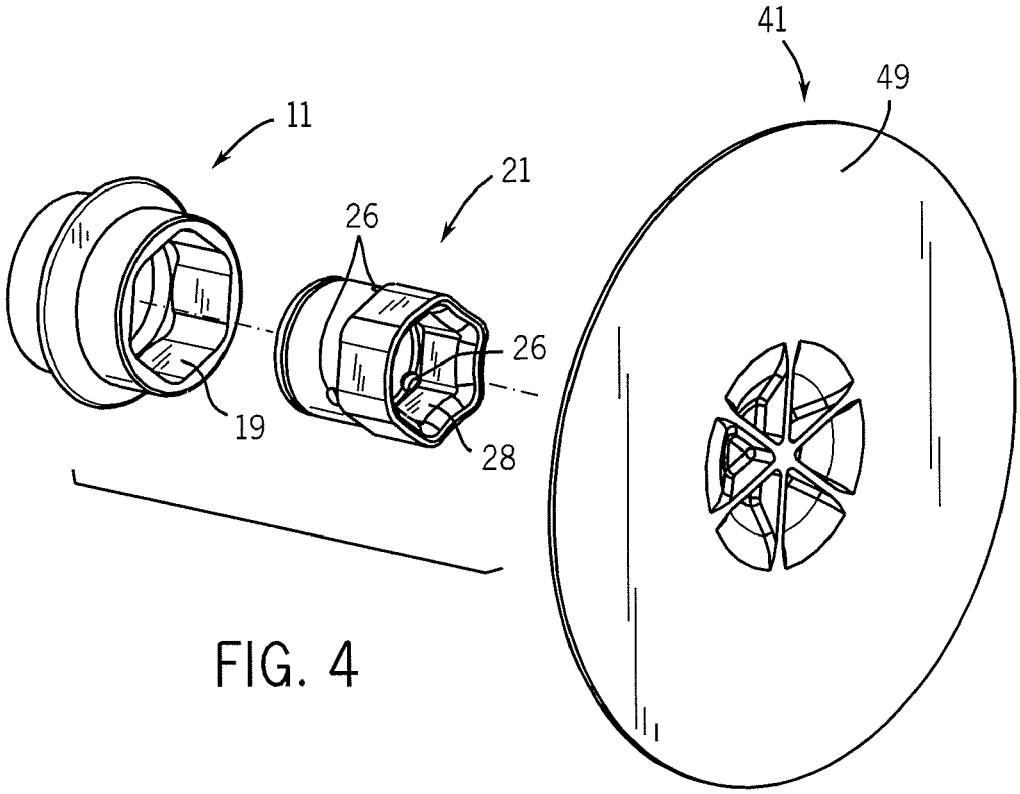
FIG. 4 is an exploded bottom and side view of the assembly shown in FIG. 2.
Figure 7:
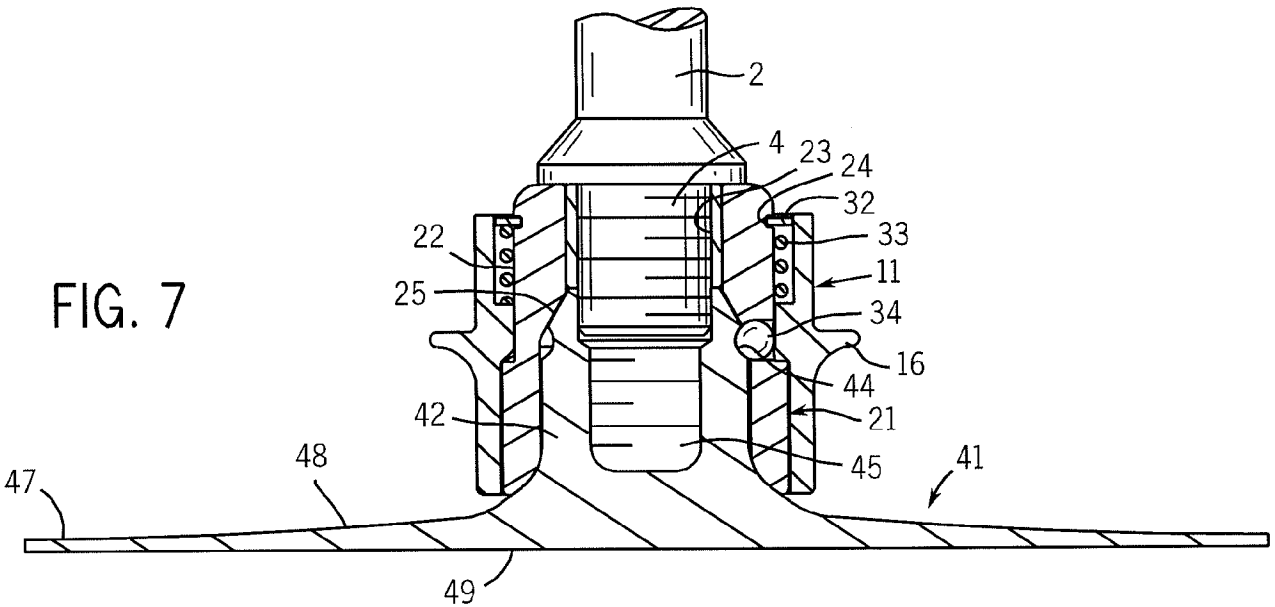
FIG. 7 is an enlarged side elevational and cross sectioned view of the quick mount adapter showing the backing plate attached to the adapter and taken along line 7-7 of FIG. 2.
Figure 8:
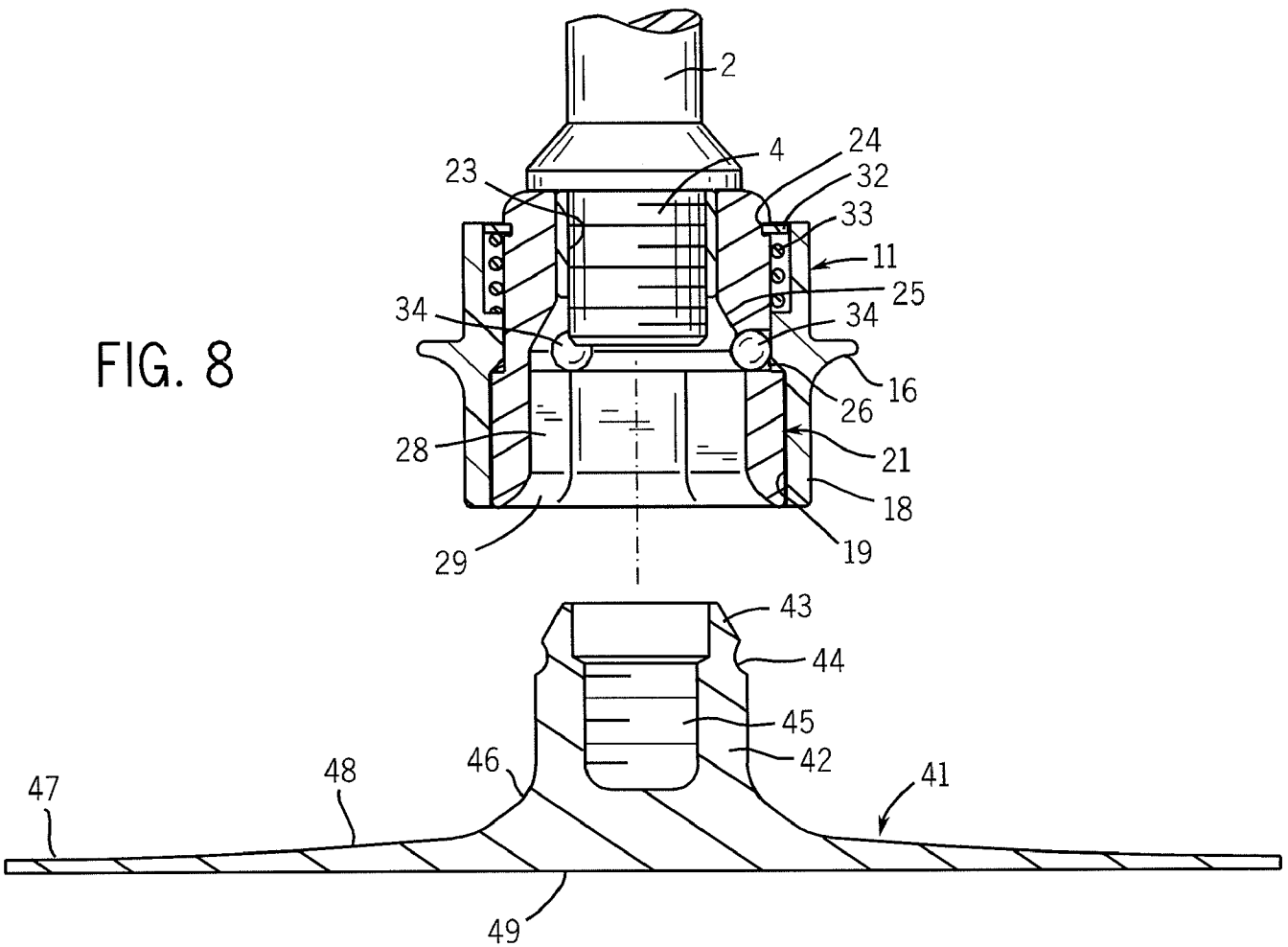
FIG. 8 is a view of the quick mount adapter and backing plate that is similar to FIG. 7 but showing the adapter prior to attachment of it to the backing plate.
Figure 9:
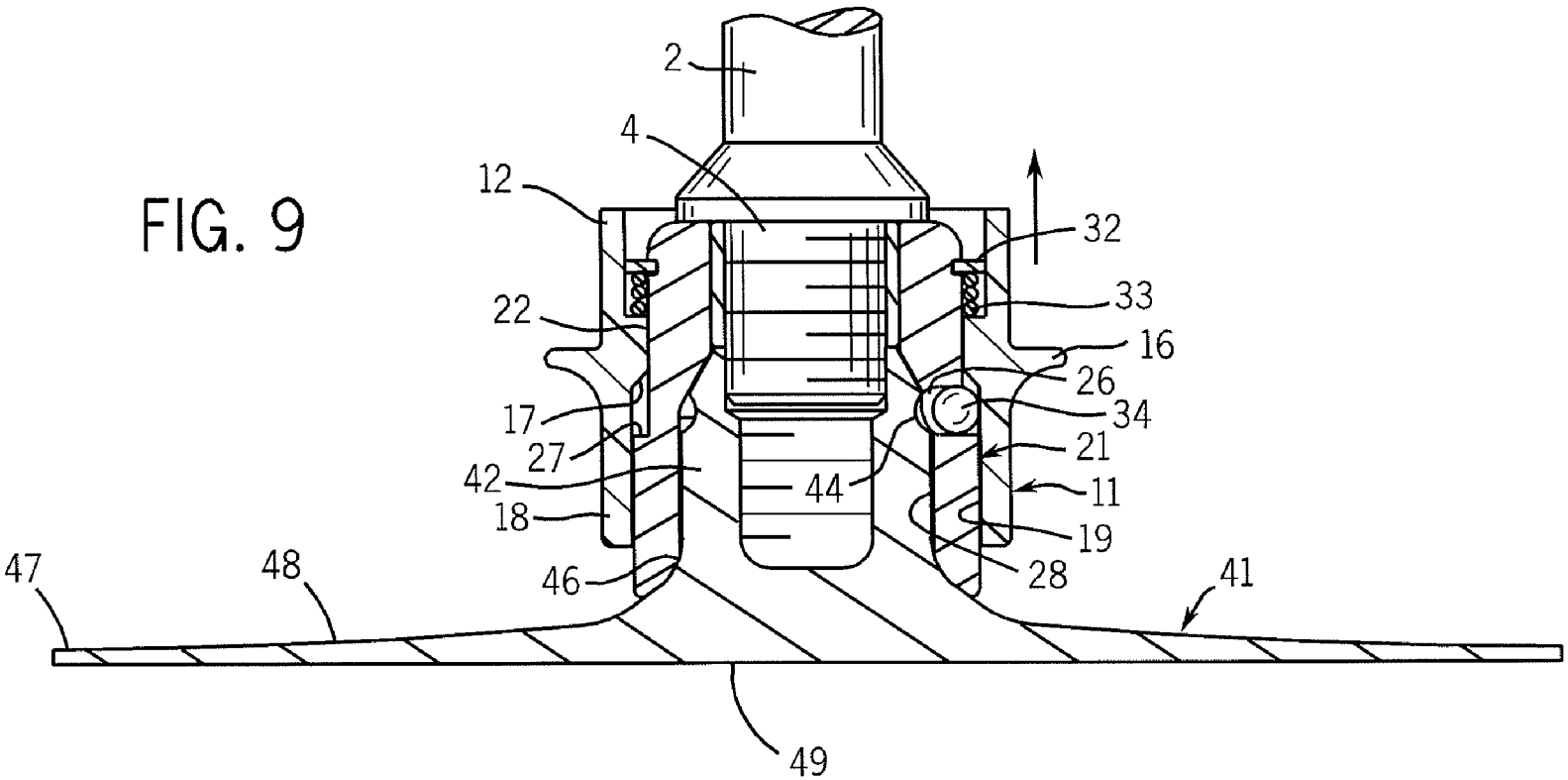
FIG. 9 is another view of the quick mount adapter and backing plate that is similar to both FIGS. 7 and 8 but showing a portion of the adapter being retracted to allow for attachment of the backing plate to the adapter.

Referring briefly to FIGS. 7 through 9, it will be seen that the threaded portion 4 of the drive spindle 2 is intended to be threadably receivable within a cylindrically-shaped aperture 23 of the inner sleeve 21, the aperture 23 being like-threaded. Referring again to FIG. 10, it will be seen that the inner sleeve 21 of the quick mount adapter 10 further includes an outer surface 22, the uppermost portion of the outer surface 22 having a circumferentially-disposed aperture 24 defined within it. This aperture 24 is functionally adapted to receive the innermost portion of the ring 32. Extending downwardly along the outer surface 22 of the inner sleeve 21 is a circumferentially-disposed outer shoulder 27. Moving downwardly along the inner structure of the inner sleeve 21, it will be seen that the threaded aperture 23 of the inner sleeve 21 further includes an inner ramped surface 25 which leads to a hexagonally-shaped internal aperture 28. See FIG. 4 as well. This internal aperture 28 also has a hexagonally-shaped opening 29 at the bottommost portion of the inner sleeve 21. It should be noted here that the lowermost portion of the outer surface 22 is also hexagonally shaped, as is shown most clearly in FIG. 4.

The purpose of the hexagonal shaping of the aperture 28 and opening 29 of the inner sleeve 21 will be apparent later in this detailed description. It should also be mentioned here that the present invention is not limited to the hexagonal shape of the aperture 28 and opening 29, or their cooperating parts. Any geometric and non-cylindrical shape could be used within the scope of the present invention. Additionally, a cylindrical shape could be used with a minor adaptation to the backing plate 41 and to the outer sleeve 11, as will be apparent later in this detailed description.

Disposed within the inner sleeve 21 at the point of transition between the ramped portion 25 and the lower aperture 28 are several openings 26. Each of the openings 26 is radially-disposed within the inner sleeve 21 and is functionally adapted to receive a round ball 34 within it. However, that part of the opening 26 that is at the ramped portion 25 and lower aperture 28 is of a diameter that is smaller than that of the ball 34. This configuration allows a portion of the ball 34 to protrude from the opening 26 but not to pass through it. See, for example, FIG. 8.

As alluded to previously, the assembly 10 in the preferred embodiment of the present invention further includes a cylindrically-shaped outer sleeve 11. Referring again to FIG. 10, it will be seen that this outer sleeve 11 comprises an upper sleeve portion 12 and a lower sleeve portion 18. The upper sleeve portion 12 defines a cylindrically-shaped upper aperture 13 and the lower portion 18 similarly defines a hexagonally-shaped lower aperture 19. See also FIG. 4. Disposed between the upper and lower apertures 13, 19, respectively, is a slightly narrower, but also cylindrically-shaped, inner aperture portion 15, and a cylindrically-shaped ramped portion 17 that is disposed immediately below the inner aperture portion 15 which transitions the inner aperture portion 15 to the lower aperture 19, the lower aperture 19 being hexagonally-shaped to prevent rotation of the outer sleeve 11 relative to the inner sleeve 21 relative to the axis A. The upper aperture 13 of the inner sleeve 21 further includes a shoulder portion 14 that is disposed immediately above the inner aperture portion 15. The outside surface of the outer sleeve 11 further includes a pull flange 16, the pull flange being circumferentially-defined about the outer sleeve 11. It should also be mentioned here that the lower aperture 19 of the outer sleeve 11 could be configured in a cylindrical shape (not shown) as well. The functionality of a cylindrical configuration would require an alteration in the design of the backing plate 41, as will be apparent later in this detailed description.

Figure 6:
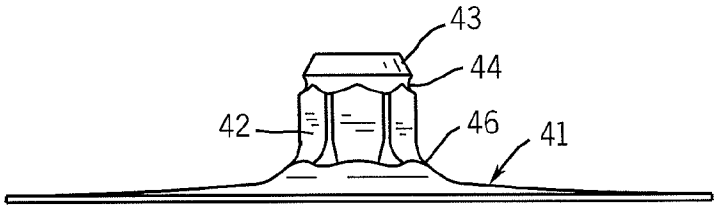
FIG. 6 is a side elevational view of the backing plate shown in FIG. 3.
Figure 5:
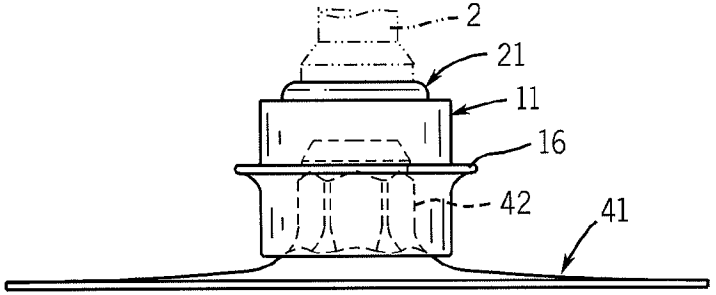
FIG. 5 is a side elevational view of the quick mount adapter and backing plate illustrated in FIG. 2.

As shown in FIGS. 5 and 6, for example, the preferred embodiment of the present invention discloses that the spring 33 is captured within a space that is created between the inner sleeve 21 and the outer sleeve 11 when the quick mount adapter 10 is assembled. More specifically, the spring 33 is disposed between the cylindrically-shaped wall of the upper aperture 13 of the outer sleeve 11 and the cylindrically-shaped outer surface 22 of the inner sleeve 21. One end of the spring 33 is biased against the shoulder portion 14 of the outer sleeve 11. The opposite end of the spring 33 is biased against the ring 32, the ring 32 being retained within the circumferentially-disposed aperture 24 of the inner sleeve 21. In the preferred embodiment, the outer diameter of the ring 32 closely matches the inner diameter of the upper aperture 13 of the outer sleeve 11 such that the outer surface of the ring 32 clears the inner surface of the upper aperture 13 when the outer sleeve 11 is retracted upwardly relative to the inner sleeve 21. See FIG. 9.

Referring once again to FIG. 10, it will be seen that the backing plate 41 in the preferred embodiment of the present invention includes a centrally-disposed hub 42 that rises upwardly from a disk portion 47, the disk portion having a front face 49 and a rear face 48. The rear face 48 includes a radius 46 that ramps upwardly towards the hub 42 of the backing plate 41. It should also be noted that the outer profile of the hub 42 is hexagonally-shaped, this shape matching the hexagonal shape of the aperture 28 and opening 29 of the inner sleeve 21. See FIGS. 3, 4 and 6, in particular. The uppermost portion 43 of the hub 42 of the backing plate 41 includes a circumferentially defined groove 44 within it and a centrally disposed aperture 45, the centrally disposed aperture 45 being threaded so as to match the threaded portion 4 of the drive spindle 2. The radius of the groove 44 that is defined within the backing plate hub 42 substantially matches that of the balls 34 that are included with the assembly 10 of the present invention. See FIG. 7. It is to be understood that a plurality of dimples, or concave detents (not shown), could be defined at the flat face portions along the hexagonally-shaped hub 42 as an alternative "keeper" configuration, the radius of each dimple or detent substantially matching that of the balls 34. In such an alternative configuration, the configuration of the inner sleeve 21 and the outer sleeve 11, and particularly the placement of the openings 26 of the inner sleeve 21, would be modified as well.

The foregoing would be particularly true where, for example, the hub 42 was a cylindrically-shaped structure (not shown) having a plurality of detents (also not shown) defined within the hub, the detents being used to capture the balls 34 that would be held between the similarly-configured cylindrically-shaped lower aperture 29 of the inner sleeve 21 and the outer sleeve 11. It is to be understood that where the hub 42 and the functionally cooperating inner sleeve 21 and outer sleeve 11 are hexagonally-shaped or other geometrically-shaped, the hub is maintained in axial position by the balls engaging the groove 44 or the detents defined within the backing plate hub 42. The hexagonally-shaped hub 42, or other geometrically-shaped configuration, prevents rotation about the axis A during use of the assembly 10 of the present invention. In the situation where the hub 42 and the functionally-cooperating inner sleeve 21 and outer sleeve 11 are cylindrically-shaped structures, the capturing of the balls 34 within the detents operates to prevent axial movement of the assembly 10 away from the tool 1 but also prevents rotation about the axis A as well. In short, a cylindrical design employees the balls 34 to serve a dual function to both drive the radial motion of the backing plate 41 as well as retain the backing plate 41 while it is engaged with the quick release adapter 10.

It is also to be understood that the disk portion 47 of the backing plate 41 would have attached to it a surface care media of some sort, such as a buffing pad or the like. As alluded to earlier, the exact type of surface care media is not, however, a limitation of the present invention.

It should also be noted that the inner and outer sleeves 21, 11, respectively, of the adapter 10, as well as the backing plate 41, are made of a plastic material in the preferred embodiment of the present invention. The ring 32, spring 33 and balls 34, however, are made of a metal material in the preferred embodiment.

It should be noted that the figures also illustrate how the quick mount adapter 10 interfaces with an externally threaded male drive spindle of a typical rotary care tool. Externally threaded drive spindles or adapters either to the backing plate 41 or the quick release adapter 10 would provide the ability to be compatible with other internally threaded drive spindles that are commonly found on oscillating or dual-action or orbital surface care tools. These externally threaded spindles could be molded into the backing plate 41 and quick release adapter 10 as options to the internally threaded design detailed in the attached figures or by using male/female threaded adapters which can be inserted into the components as illustrated.

In application, the user would most likely hold the surface care tool 1 in one hand and the quick mount adapter 10 in the other hand. With the threaded portion 4 of the drive spindle 2 of the surface care tool 1 aligned with the threaded aperture 23 of the inner sleeve 21, the user would rotate the quick mount adapter 10 so as to thread the quick mount adapter 10 onto the drive spindle 2. The user would then pull back on the quick mount adapter 10, drawing it towards the surface care tool 1, by holding on to the pull flange 16 that is circumferentially-defined about the outer sleeve 11. See FIG. 9. By pulling the outer sleeve 11 towards the spindle 2, this allows the balls 34 to roll or move along the ramped portion 17 of the outer sleeve 11 and partially along the lower aperture 19. This action compresses the spring 33 and allows the uppermost portion 43 of the backing plate 41 to be fully inserted into the hexagonally-shaped internal aperture 28 of the inner sleeve 21.

With the inner sleeve 21 in a position such that the balls 34 can now engage grooved aperture 44 of the backing plate 41, the user would then allow the outer sleeve 11 to move away from the spindle 2, the outer sleeve 11 being urged in that direction by force exerted on it by means of the captured spring 33, the captured spring 33 having been previously compressed. See FIG. 5. At this point, the user would be able to use the backing plate 41 and its attached surface care media 51 to buff a surface, for example.

In order to remove the backing plate 41 and its attached surface care media 51 from the quick mount adapter 10, the same action mentioned above would be used. That is, the user would pull the quick mount adapter 10 towards the spindle 2 of the surface care tool 1, thereby releasing the balls 34 from the backing plate groove 44 and allowing the backing plate 41 and media 51 to be withdrawn from the inner sleeve aperture 28. It should be noted here that the user can accomplish this removal without any need to physically handle the backing plate 41 and its attached surface care media. Following a surface preparation step, the media may be contaminated with surface particulate and, as the user moves on to the next surface preparation or finishing step, it is beneficial to the quality of the end product that media not be cross-contaminated through handling by the user. In accordance with the present invention, this is avoided.

Figure 11:
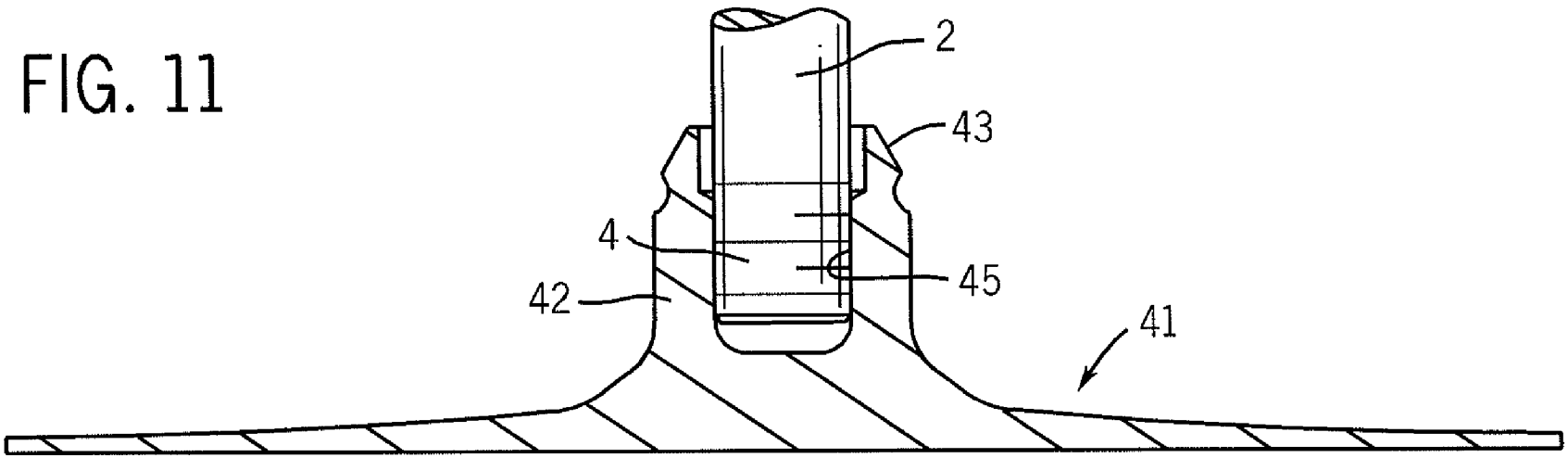
FIG. 11 is another partially cross-sectioned view of the backing plate as it would be used with the drive spindle of a surface care tool but without the quick mount adapter attached to it.

In an alternative application, the quick mount adapter 10 could be omitted entirely because the threaded portion 4 of the drive spindle 2 of the surface care tool 1 can be inserted directly into the threaded aperture 45 of the backing plate 41. See FIG. 11. This would allow the backing plate to be used in a more conventional application, the backing plate 41 being configured for use with or without the quick mount adapter 10.

In view of the foregoing, it will be seen that there has been provided a new and useful system and apparatus that allows the user to quickly and easily remove the backing plate and its associated surface care media from a surface care tool; that provides such a system and apparatus whereby a minimal number of elements and a minimal number of steps are required to use the system and apparatus, thereby making the system and apparatus easy and simple to use; that provides such a system and apparatus whereby the backing plate is securely attached to the backing plate to the surface care tool such that the backing plate will not inadvertently detach from the tool under use conditions; and that provides such a system and apparatus whereby the user can utilize the backing plate of the system and apparatus with the threaded spindle of a conventional surface care tool and without the quick mount adapter when such is desired or required.

The details of the invention having been disclosed in accordance with the foregoing, we claim:

1. A system for use with a surface care tool, said surface care tool comprising a drive spindle and an externally threaded portion integrally formed on the drive spindle, the system comprising a backing plate, the backing plate comprising a hub, a surface care media attached to the backing plate, and a quick mount adapter for selectively attaching the backing plate to the tool and releasing the backing plate from the tool, the quick mount adapter comprising an inner sleeve member and an outer sleeve member, the sleeve members being axially movable and spring-biased in relation to one another, a plurality of balls disposed between the sleeve members to engage a groove that is disposed within the hub of the backing plate, wherein the balls disposed between the sleeve members are used to selectively capture the hub of the backing plate within the quick mount adapter when the balls are held within the hub groove, said hub further comprising a centrally-disposed and threaded inner aperture, said threaded inner aperture being complementary to the threaded portion of the drive spindle of the surface care tool such that the backing plate can be used without the outer sleeve member, the inner sleeve member, the plurality of balls and the hub groove.

2. The system of claim 1 wherein the groove disposed within the hub of the backing plate is disposed circumferentially about the hub.

3. The system of claim 1 wherein the hub of the backing plate further comprises a geometrically-shaped structure that is complementary to a like-shaped structure within the quick mount adapter.

4. The system of claim 3 wherein the hub is a hexagonally-shaped structure.

5. The system of claim 1 wherein the quick mount adapter allows the user to remove the backing plate and the surface care media attached to the backing plate without cross-contaminating other like-configured backing plates during use.

6. A system for use with a surface care tool, said surface care tool comprising a drive spindle and an externally threaded portion integrally formed on the drive spindle, the system comprising a backing plate, the backing plate comprising a hub, a surface care media attached to the backing plate, and a quick mount adapter for selectively attaching the backing plate to the tool and releasing the backing plate from the tool, the quick mount adapter comprising an inner sleeve member and an outer sleeve member, the sleeve members being axially movable and spring-biased in relation to one another, a plurality of balls disposed between the sleeve members to engage a plurality of detents disposed within the hub of the backing plate, wherein the balls disposed between the sleeve members are used to selectively capture the hub of the backing plate within the quick mount adapter when the balls are held within the plurality of detents, said hub further comprising a centrally-disposed and threaded inner aperture, said threaded inner aperture being complementary to the threaded portion of the drive spindle of the surface care tool such that the backing plate can be used without the outer sleeve member, the inner sleeve member, the plurality of balls and the plurality of detents.

7. An apparatus for use with a surface care tool, said surface care tool comprising a drive spindle and an externally threaded portion integrally formed on the drive spindle, the apparatus comprising a backing plate, the backing plate comprising a hub, a surface care media attached to the backing plate, and a quick mount adapter, the quick mount adapter comprising an inner sleeve member and an outer sleeve member, the sleeve members being axially movable and spring-biased in relation to one another, a plurality of balls disposed between the sleeve members to engage a circumferential groove that is disposed within the hub of the backing plate, the balls being used to capture the hub of the backing plate within the quick mount adapter when the balls are held within the hub groove, said hub further comprising a centrally-disposed and threaded inner aperture, said threaded inner aperture being complementary to the threaded portion of the drive spindle of the surface care tool such that the backing plate can be used without the outer sleeve member, the inner sleeve member, the plurality of balls and the hub groove.

8. The apparatus of claim 7 wherein the groove disposed within the hub of the backing plate is disposed circumferentially about the hub.

9. The apparatus of claim 7 wherein the hub of the backing plate further comprises a geometrically-shaped structure that is complementary to a like-shaped structure within the quick mount adapter.

10. The apparatus of claim 9 wherein the hub is a hexagonally-shaped structure.

11. The apparatus of claim 7 wherein the quick mount adapter allows the user to remove the backing plate and the surface care media attached to the backing plate without cross-contaminating other like-configured backing plates during use.

12. An apparatus for use with a surface care tool, said surface care tool comprising a drive spindle and an externally threaded portion integrally formed on the drive spindle, the apparatus comprising a backing plate, the backing plate comprising a hub, a surface care media attached to the backing plate, and a quick mount adapter for selectively attaching the backing plate to the tool and releasing the backing plate from the tool, the quick mount adapter comprising an inner sleeve member and an outer sleeve member, the sleeve members being axially movable and spring-biased in relation to one another, a plurality of balls disposed between the sleeve members to engage a plurality of detents disposed within the hub of the backing plate, wherein the balls disposed between the sleeve members are used to selectively capture the hub of the backing plate within the quick mount adapter when the balls are held within the plurality of detents, said hub further comprising a centrally-disposed and threaded inner aperture, said threaded inner aperture being complementary to the threaded portion of the drive spindle of the surface care tool such that the backing plate can be used without the outer sleeve member, the inner sleeve member, the plurality of balls and the plurality of detents.

13. A system for use with a surface care tool, said surface care tool comprising a drive spindle and an externally threaded portion integrally formed on the drive spindle, the system comprising a cylindrically-shaped outer sleeve, said outer sleeve comprising an upper sleeve portion and a lower sleeve portion, the upper sleeve portion defining a cylindrically-shaped upper aperture and the lower portion defining a geometrically-shaped lower aperture, a cylindrically-shaped ramped portion disposed between the upper aperture and the lower aperture, a shoulder portion, and a pull flange that is circumferentially-defined about the outer sleeve, an inner sleeve, a portion of which is cylindrically-shaped, said inner sleeve comprising an outer surface, an internally-threaded aperture at the uppermost portion of the inner sleeve, the internally-threaded aperture being functionally adapted to mesh with the threaded portion of the drive spindle to removably attach the inner sleeve to the drive spindle, a plurality of radially-disposed openings, and a geometrically-shaped inner opening at the lowermost portion of the inner sleeve, the geometric shape of the inner opening being functionally adapted to complement the geometric shape of the lower aperture of the outer sleeve, a ring, said ring being captured within a circumferential aperture defined within the outer surface of the uppermost portion of the inner sleeve, a spring, said spring being captured between the ring and the outer sleeve shoulder, a plurality of balls, said balls being radially movable within the inner sleeve openings and along the ramped portion of the outer sleeve, a backing plate, said backing plate comprising a disk portion and a centrally-disposed hub extending upwardly from the disk portion, said hub being geometrically-shaped to complement the geometric shape of the inner opening at the lowermost portion of the inner sleeve, and a groove defined within the outer profile of the hub, and a surface care media attached to the backing plate, said hub further comprising a centrally-disposed and threaded inner aperture, said threaded inner aperture being complementary to the threaded portion of the drive spindle of the surface care tool such that the backing plate can be used without the outer sleeve, inner sleeve, ring, spring and plurality of balls.

14. The system of claim 13 wherein the groove disposed within the hub of the backing plate is disposed circumferentially about the hub.

15. The system of claim 13 wherein the hub of the backing plate further comprises a geometrically-shaped structure that is complementary to a like-shaped structure within the quick mount adapter.

16. The system of claim 15 wherein the hub is a hexagonally-shaped structure.

17. The system of claim 13 wherein the disk portion of the backing plate comprises a front face and a rear face, the hub of the backing plate extending upwardly from the rear face of the backing plate and the surface care media being attached to the front face of the backing plate.

18. An apparatus for use with a surface care tool, said surface care tool comprising a drive spindle and an externally threaded portion integrally formed on the drive spindle, the apparatus comprising a cylindrically-shaped outer sleeve, said outer sleeve comprising an upper sleeve portion and a lower sleeve portion, the upper sleeve portion defining a cylindrically-shaped upper aperture and the lower portion defining a geometrically-shaped lower aperture, a cylindrically-shaped ramped portion disposed between the upper aperture and the lower aperture, a shoulder portion, and a pull flange that is circumferentially-defined about the outer sleeve, an inner sleeve, a portion of which is cylindrically-shaped, said inner sleeve comprising an outer surface, an internally-threaded aperture at the uppermost portion of the inner sleeve, the internally-threaded aperture being functionally adapted to mesh with the threaded portion of the drive spindle to removably attach the inner sleeve to the drive spindle, a plurality of radially-disposed openings, and a geometrically-shaped inner opening at the lowermost portion of the inner sleeve, the geometric shape of the inner opening being functionally adapted to complement the geometric shape of the lower aperture of the outer sleeve, a ring, said ring being captured within a circumferential aperture defined within the outer surface of the uppermost portion of the inner sleeve, a spring, said spring being captured between the ring and the outer sleeve shoulder, a plurality of balls, said balls being radially movable within the inner sleeve openings and along the ramped portion of the outer sleeve, a backing plate, said backing plate comprising a disk portion and a centrally-disposed hub extending upwardly from the disk portion, said hub being geometrically-shaped to complement the geometric shape of the inner opening at the lowermost portion of the inner sleeve, and a groove defined within the outer profile of the hub, said hub further comprising a centrally-disposed and threaded inner aperture, said threaded inner aperture being complementary to the threaded portion of the drive spindle of the surface care tool such that the backing plate can be used without the outer sleeve, inner sleeve, ring, spring and the plurality of balls, and a surface care media attached to the backing plate.

19. The apparatus of claim 18 wherein the groove disposed within the hub of the backing plate is disposed circumferentially about the hub.

20. The apparatus of claim 18 wherein the hub of the backing plate further comprises a geometrically-shaped structure that is complementary to a like-shaped structure within the quick mount adapter.

21. The apparatus of claim 20 wherein the hub is a hexagonally-shaped structure.

22. The apparatus of claim 18 wherein the disk portion of the backing plate comprises a front face and a rear face, the hub of the backing plate extending upwardly from the rear face of the backing plate and the surface care media being attached to the front face of the backing plate.

* * * * *